US008105444B2

(12) United States Patent
Tamura

(10) Patent No.: US 8,105,444 B2
(45) Date of Patent: Jan. 31, 2012

(54) PROCESS FOR PRODUCING HIGHLY ANTICORROSIVE RARE EARTH PERMANENT MAGNET AND METHOD OF USING THE SAME

(75) Inventor: Kazuo Tamura, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 287 days.

(21) Appl. No.: 12/522,779

(22) PCT Filed: May 30, 2007

(86) PCT No.: PCT/JP2007/060947

§ 371 (c)(1),
(2), (4) Date: Jul. 10, 2009

(87) PCT Pub. No.: WO2008/146368

PCT Pub. Date: Dec. 4, 2008

(65) Prior Publication Data

US 2010/0013585 A1 Jan. 21, 2010

(51) Int. Cl.
*H01F 1/057* (2006.01)

(52) U.S. Cl. ..... 148/101; 148/302; 148/253; 427/130; 428/472.3

(58) Field of Classification Search ..... None
See application file for complete search history.

(56) References Cited

U.S. PATENT DOCUMENTS

| | | | | |
|---|---|---|---|---|
| 5,013,411 | A * | 5/1991 | Minowa et al. | 205/119 |
| 2002/0033205 | A1 | 3/2002 | Tamura et al. | |
| 2005/0028890 | A1 | 2/2005 | Sakaki et al. | |

FOREIGN PATENT DOCUMENTS

| | | | |
|---|---|---|---|
| EP | 0 345 092 | A1 | 12/1989 |
| EP | 1 467 385 | A1 | 10/2004 |
| JP | 7-230928 | A | 8/1995 |
| JP | 2002-57052 | A | 2/2002 |
| JP | 2002-80882 | A | 3/2002 |
| JP | 2002-158105 | A | 5/2002 |
| JP | 2003-257768 | A | 9/2003 |
| JP | 2006-165217 | A * | 6/2006 |
| JP | 2006-165218 | A * | 6/2006 |

OTHER PUBLICATIONS

Japanese Office Action issued on Nov. 10, 2010 in related Japanese Patent Application No. 2006-154832.
Supplementary European Search Report issued on Apr. 27, 2010 in corresponding European Patent Application No. 07 74 4366.

* cited by examiner

*Primary Examiner* — John Sheehan
(74) *Attorney, Agent, or Firm* — Birch, Stewart, Kolasch & Birch, LLP

(57) ABSTRACT

A process for producing a highly anticorrosive rare earth permanent magnet, characterized by sequentially subjecting an R—Fe—B sintered magnet to surface finishing involving cutting and/or polishing, plating pretreatment, nickel electroplating to a given plating thickness, immersion in an aqueous solution containing a phosphoric salt, washing with water and heat treatment at 150° to 400° C. for 1 to 24 hr in an atmosphere of $1.3\times10^3$ Pa or higher oxygen partial pressure so as to form a thin nickel oxide layer at the surface layer portion.

7 Claims, 5 Drawing Sheets

PROCESS FOR PRODUCING HIGHLY ANTICORROSIVE RARE EARTH PERMANENT MAGNET AND METHOD OF USING THE SAME

TECHNICAL FIELD

This invention relates to a method for preparing rare earth permanent magnets which are exposed to oil-type metalworking fluids or water-miscible metalworking fluid compositions over a long term and especially highly corrosion resistant rare earth permanent magnets which are suitable for use in linear motors for machine tools, and the use of the magnets.

BACKGROUND ART

By virtue of excellent magnetic properties and economy, rare earth permanent magnets find use in many areas of electric and electronic equipment. Recently the amount of these magnets produced has marked a dramatic increase. Among others, neodymium rare earth permanent magnets have lower feedstock costs than samarium-cobalt magnets because the primary element, neodymium exists in more plenty than samarium and the amount of cobalt used is smaller. They also have much better magnetic properties than samarium-cobalt magnets. For this reason, the neodymium rare earth permanent magnets are now applied not only to small-sized magnetic circuits where samarium-cobalt magnets have been used, but also to the fields where hard ferrite or electromagnets have been used. Also in the area of motors in compressors for use in air conditioners and refrigerators, a transition from traditional induction motors and synchronous rotating electric machines using ferrite magnets to DC brushless motors using neodymium rare earth magnets is taking place for the purposes of increasing energy efficiency and reducing power consumption.

However, R—Fe—B permanent magnets have the drawback that they are readily oxidized in humid air within a short time since they contain rare earth elements and iron as the main components. When these magnets are incorporated in magnetic circuits, oxidative corrosion raises such problems as decreased outputs of magnetic circuits and contamination of peripheral equipment with the rust resulting therefrom. Then, rare earth magnets are generally surface treated prior to use. Suitable surface treatments made on rare earth magnets include electroplating, electroless plating, and even Al ion plating and various coating processes. The environmental factor to which R—Fe—B permanent magnets are exposed during the process is mainly temperature or humidity.

In industrial motors and air conditioner compressor motors, on the other hand, there exist environmental factors inherent to the environment where rare earth permanent magnets are used. For example, rare earth permanent magnets are always exposed to chemical fluids such as cutting fluids or mixtures of refrigerant and refrigerating machine oil at high temperature and high pressure. Rare earth permanent magnets must be highly reliable, typically fully corrosion resistant in such unique environments.

Particularly when rare earth permanent magnets are used in linear motors for machine tools, it is believed that they offer high acceleration and high-speed rotation capabilities, enabling higher speed machining than in the prior art. It is often the case that on use, industrial motors are exposed not only to compression gases like fluorocarbons such as hydrofluorocarbons (HFC), but also to chemically active gases such as pure hydrogen and pure ammonia.

In the case of linear motors for use in high-speed machining, unless magnets have sufficient resistance to cutting fluids, the magnets may undergo progressive corrosion reaction with cutting fluids during long-term operation and degrade in magnetic properties, so that the motors fail to exert their performance to a full extent. Similarly, in the case of motors for use in an atmosphere having a certain partial pressure of pure hydrogen or pure ammonia, unless magnets have sufficient corrosion resistance, magnets undergo progressive corrosion reaction during long-term operation and degrade in magnetic properties, so that the motors fail to exert their performance to a full extent.

Then, in these applications, it is under consideration to implement various surface treatments as mentioned above. There is a strong need for a surface treatment capable of providing sufficient corrosion resistance in an environment exposed on actual use.

Such a surface treatment, if established, makes it possible to enhance the efficiency and reliability of various industrial motors, and is of great significance.

When R-T-B permanent magnets are used in high-efficiency motors, the magnets are generally exposed to an environment where air is moist, typically a hot humid environment. Magnets are also exposed to a special environment when high-efficiency motors are used in air conditioner compressors using both a HFC or HCFC refrigerant and a refrigerating machine oil such as mineral oil, ester oil or ether oil. A method for preparing a rare earth permanent magnet for use in such a special environment is disclosed in JP-A 2002-57052.

There is still a desire to have a rare earth permanent magnet providing cutting fluid resistance with respect to water-miscible metalworking agent compositions, especially amine-containing water-miscible cutting fluids.

DISCLOSURE OF THE INVENTION

Problems to be Solved by the Invention

In the light of the above problems, an object of the invention is to provide a method for preparing a highly corrosion resistant rare earth permanent magnet of R-T-B system, typically R—Fe—B system which has not only corrosion resistance to mineral oil-based water-immiscible cutting fluids, but also sufficient resistance to cutting fluids like water-miscible metalworking fluid compositions, especially amine-containing water-miscible cutting fluids, which are potentially less detrimental to the global environment and human body; and use of the magnet.

Means for Solving the Problems

Making studies on the surface treatment of rare earth magnets for providing cutting fluid resistance, the inventors have found that a surface treatment procedure involving forming a nickel electroplating film on a surface of a rare earth permanent magnet, immersing in a phosphate-containing aqueous solution, washing with water, drying, and heat treatment in an air composition atmosphere or at an equivalent oxygen activity for forming a $Ni_2O_3$ layer having a thickness within 200 nm on a plating surface is very effective.

Specifically, if an R-T-B rare earth magnet is surface covered with a highly corrosion resistant material without defects, there is no possibility of metal values being corroded as long as the material is not dissolved away. If the covering material has certain defects, however, the corrosive substance can invade through the defective sites so that corrosion takes place.

In general, corrosion reaction proceeds electrochemically. Whether or not corrosion proceeds under a certain atmosphere can be presumed by comparing the electrochemical electrode potential of a chemical substance present in the reaction system. Accordingly, the corrosion reaction may be restrained by inhibiting redox reaction from taking place on a magnet surface and shifting the electrode potential at the reaction interface to a passive state region.

If a metal oxide layer which promotes hydrogen reduction reaction is formed on a surface of an R-T-B rare earth permanent magnet to a thickness equal to or more than a predetermined level so that poisoning action relative to chemically active substances is maintained, and the electrode potential at R-T-B rare earth permanent magnet surface is shifted to the passive state region, then corrosion of the R-T-B rare earth permanent magnet can be restrained.

As a general rule, nickel plating is often effected on R-T-B rare earth permanent magnets for providing corrosion resistance.

According to the invention, nickel plating is effected on an R-T-B rare earth permanent magnet, the magnet is immersed in a phosphate-containing aqueous solution, washed with water and dried, and the nickel plating is heat treated in a controlled atmosphere while controlling the thickness of a layer formed by the treatment, whereby nickel oxide which promotes hydrogen reduction reaction is formed on the R-T-B rare earth permanent magnet surface, and poisoning action relative to chemically active substances is obtained.

Accordingly, the invention provides:

[1] A method for preparing a highly corrosion resistant rare earth permanent magnet, comprising the sequential steps of casting an alloy, said alloy containing R which is a rare earth element or a combination of two or more rare earth elements, T which is Fe or Fe and Co, and B as main components, and specifically consisting essentially of 26.8 to 33.5% by weight of R, 0.78 to 1.25% by weight of B, 0.05 to 3.5% by weight in total of at least one element selected from the group consisting of Ni, Ga, Zr, Nb, Hf, Ta, Mn, Sn, Mo, Zn, Pb, Sb, Al, Si, V, Cr, Ti, Cu, Ca, and Mg, and the balance of T and incidental impurities, pulverizing the alloy in an oxygen-free atmosphere of argon, nitrogen or vacuum, finely pulverizing, compacting in a magnetic field, sintering, and aging, thereby producing a sintered magnet, the magnet having an oxygen concentration of up to 0.6% by weight and magnetic properties, Br of 12.0 kG to 14.8 kG and iHc of 11 kOe to 35 kOe, said method further comprising the steps of machining and/or grinding the magnet for surface finish, pretreating with mineral acid or the like, nickel electroplating to form a plating of a predetermined thickness, immersing in a phosphate-containing aqueous solution, washing with water, and heat treating in an atmosphere having an oxygen partial pressure of at least $1.3\times10^3$ Pa (10 Torr) at 150 to 400° C. for 1 to 24 hours for thereby forming a thin nickel oxide layer in a surface region of the plating.

[2] A method for preparing a highly corrosion resistant rare earth permanent magnet, comprising the sequential steps of providing a parent alloy containing R which is a rare earth element or a combination of two or more rare earth elements, T which is Fe or Fe and Co, and B as main components, and specifically consisting essentially of 26.8 to 33.5% by weight of R, 0.78 to 1.25% by weight of B, 0.05 to 3.5% by weight in total of at least one element selected from the group consisting of Ni, Ga, Zr, Nb, Hf, Ta, Mn, Sn, Mo, Zn, Pb, Sb, Al, Si, V, Cr, Ti, Cu, Ca, and Mg, and the balance of T and incidental impurities, providing an auxiliary alloy consisting essentially of 28 to 70% by weight of R' wherein R' is identical with R, 0 to 1.5% by weight of B, 0.05 to 10% by weight in total of at least one element selected from the group consisting of Ni, Ga, Zr, Nb, Hf, Ta, Mo, Al, Si, V, Cr, Ti, and Cu, and the balance of T and incidental impurities, said T consisting of at least 10% by weight of Co and up to 60% by weight of Fe based on the weight of T, subjecting the parent alloy to hydriding pulverization in an oxygen-free atmosphere of argon, nitrogen or vacuum, combining 85 to 99% by weight of the parent alloy with 1 to 15% by weight of the auxiliary alloy, finely pulverizing, compacting in a magnetic field, sintering, and aging, thereby producing a sintered magnet, the magnet having an oxygen concentration of up to 0.6% by weight and magnetic properties, Br of 12.0 kG to 14.8 kG and iHc of 11 kOe to 35 kOe, said method further comprising the steps of machining and/or grinding the magnet for surface finish, pretreating with mineral acid or the like, nickel electroplating to form a plating of a predetermined thickness, immersing in a phosphate-containing aqueous solution, washing with water, and heat treating in an atmosphere having an oxygen partial pressure of at least $1.3\times10^3$ Pa (10 Torr) at 150 to 400° C. for 1 to 24 hours for thereby forming a thin nickel oxide layer in a surface region of the plating.

[3] A method for preparing a highly corrosion resistant rare earth permanent magnet according to [1] or [2], wherein said phosphate-containing aqueous solution is an aqueous solution comprising at least one phosphate selected from the group consisting of sodium dihydrogen phosphate, potassium dihydrogen phosphate, disodium hydrogen phosphate, and dipotassium hydrogen phosphate, or said phosphate and at least one member selected from the group consisting of sulfuric acid, nitric acid, acetic acid, oxalic acid, citric acid, phosphoric acid, pyrophosphoric acid, sodium sulfate, potassium sulfate, sodium nitrate, potassium nitrate, sodium acetate, potassium acetate, sodium oxalate, potassium oxalate, sodium citrate, potassium citrate, sodium phosphate, potassium phosphate, sodium pyrophosphate, and potassium pyrophosphate.

[4] Use of the rare earth permanent magnet prepared by the method of any one of [1] to [3] as a magnet which is used in a drive mechanism of a machine tool and which comes in contact with an amine-containing water-miscible cutting fluid.

Benefits of the Invention

According to the invention, the sintered magnet is nickel electroplated, immersed in a phosphate-containing aqueous solution, washed with water and dried. Thereafter, the R—Fe—B permanent magnet on its surface is heat treated in a controlled oxygen atmosphere to form a protective coating capable of promoting hydrogen reduction reaction, for thereby imparting high corrosion resistance independent of components of which a water-miscible cutting fluid is composed.

The R-T-B magnets of the invention have sufficient corrosion resistance to cutting fluids of all types including emulsion, soluble and synthetic types used in general machining operations including turning operations by automatic lathes, transfer machines, drilling machines or the like, deep drilling operations by gun drills or the like, thread cutting operations by taps or the like, and gear cutting operations by hobbing machines, pinion cutters or the like. Then the R-T-B magnets of the invention can be used in any service environment without choice.

While amines are added to water-miscible cutting fluids for providing antibacterial properties, the R-T-B magnets of the invention are not affected at all by the amines. The R-T-B magnets of the invention characterized by satisfactory barrier properties against generally chemically reactive amines and ammonia are available in a simple manner at low costs. The invention is thus of great worth in the industry.

DESCRIPTION OF THE PREFERRED EMBODIMENTS

Figure 1:
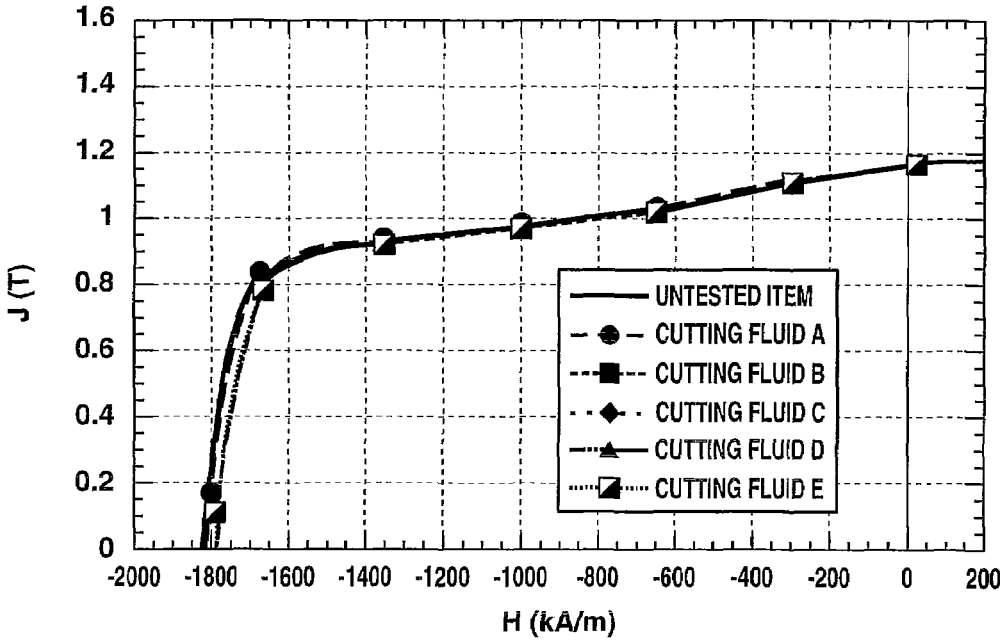
FIG. 1 is a diagram showing the magnetic properties of the magnet of Example 1 before and after the cutting fluid immersion test (80° C. and 4 weeks).

The method for preparing a rare earth permanent magnet according to the invention starts with the step of casting an alloy containing R which is a rare earth element or a combination of two or more rare earth elements, T which is Fe or a mixture of Fe and Co, and boron (B) as main components, and specifically consisting essentially of 26.8 to 33.5% by weight of R, 0.78 to 1.25% by weight of B, 0.05 to 3.5% by weight in total of at least one element selected from the group consisting of Ni, Ga, Zr, Nb, Hf, Ta, Mn, Sn, Mo, Zn, Pb, Sb, Al, Si, V, Cr, Ti, Cu, Ca, and Mg, and the balance of T and incidental impurities.

In the R-T-B permanent magnet, R accounts for 26.8 to 33.5% by weight of the composition. R is one or more rare earth elements selected from among Y, La, Ce, Pr, Nd, Pm, Sm, Gd, Tb, Dy, Ho, Er, Lu, and Yb, and preferably from among Ce, La, Nd, Pr, Dy, and Tb. Boron (B) accounts for 0.78 to 1.25% by weight. Iron (Fe) accounts for 50 to 90% by weight. Temperature properties may be improved by substituting cobalt (Co) for part of iron (Fe). If the amount of Co added is less than 0.1 wt %, no sufficient effects are achieved. An amount of Co in excess of 15 wt % may reduce the coercive force and increase the cost. For this reason, the amount of Co added is preferably 0.1 to 15% by weight. For improving magnetic properties or reducing the cost, at least one element selected from among Ni, Ga, Zr, Nb, Hf, Ta, Mn, Sn, Mo, Zn, Pb, Sb, Al, Si, V, Cr, Ti, Cu, Ca, and Mg may be added. An alloy of the above-defined composition may be obtained by melting metal feeds at or above the melting point of the alloy, and casting the melt by a suitable casting technique such as mold casting, roll quenching or atomizing.

The alloy of the above-defined composition is pulverized in an oxygen-free atmosphere of argon, nitrogen or vacuum, followed by fine pulverization, preferably to an average particle size of 1 to 30 μm, compacting in the presence or absence of a magnetic field for orientation, sintering, solution treatment, and aging, thereby producing a sintered magnet in bulk form. It is then machined and/or ground, obtaining a permanent magnet of the desired shape for practical use.

In another embodiment, the rare earth magnet can also be prepared by providing a parent alloy containing R which is a rare earth element or a combination of two or more rare earth elements, T which is Fe or a mixture of Fe and Co, and boron (B) as main components, and specifically consisting essentially of 26.8 to 33.5% by weight of R, 0.78 to 1.25% by weight of B, 0.05 to 3.5% by weight in total of at least one element selected from the group consisting of Ni, Ga, Zr, Nb, Hf, Ta, Mn, Sn, Mo, Zn, Pb, Sb, Al, Si, V, Cr, Ti, Cu, Ca, and Mg, and the balance of T and incidental impurities, providing an auxiliary alloy consisting essentially of 28 to 70% by weight of R' wherein R' is identical with R (specifically, R' is a rare earth element or a combination of rare earth elements, with R' being preferably an identical element with R), 0 to 1.5% by weight of B, 0.05 to 10% by weight in total of at least one element selected from the group consisting of Ni, Ga, Zr, Nb, Hf, Ta, Mo, Al, Si, V, Cr, Ti, and Cu, and the balance of T (consisting of at least 10% by weight of Co and up to 60% by weight of Fe based on the weight of T) and incidental impurities, subjecting the parent alloy to hydriding pulverization in an oxygen-free atmosphere of argon, nitrogen or vacuum, combining 85 to 99% by weight of the parent alloy with 1 to 15% by weight of the auxiliary alloy, finely pulverizing, compacting in a magnetic field, sintering, and aging in sequence, and further machining and/or grinding for surface finish.

At this point, the permanent magnet has an oxygen concentration of up to 0.6% by weight and magnetic properties, a residual flux density Br of 12.0 kG to 14.8 kG and a coercive force iHc of 11 kOe to 35 kOe.

The sintered magnet prepared as above is machined and/or ground for surface finish and then pretreated for plating by a standard technique using mineral acid such as sulfuric acid, hydrochloric acid, nitric acid or the like.

According to the invention, nickel electroplating is then effected on the magnet. The nickel electroplating may be effected not only in a Watt nickel bath having nickel sulfate, nickel chloride and boric acid dissolved therein, but also in any industrially established nickel plating baths including nickel sulfamate and Wood's strike baths. It is understood that electroless nickel plating fails to attain the object of the invention due to the drawback that when a Ni—P alloy plating resulting from electroless nickel plating is heat treated, especially at or above 400° C., the plating which has been amorphous or microcrystalline as deposited becomes hardened because the heat creates metal compounds such as $Ni_3P$ within the nickel matrix and introduces strains at the same time. For electroplating to deposit nickel on an R-T-B rare earth permanent magnet, any technique such as rack plating, barrel plating or the like may be employed. The nickel plating layer deposited on the R-T-B rare earth permanent magnet should preferably have a thickness of 5 to 40 μm, more preferably 10 to 30 μm, and even more preferably 15 to 25 μm.

After a nickel plating is formed on the magnet surface by electroplating, it is further treated by immersing in a phosphate-containing aqueous solution. The phosphate used herein is preferably at least one salt selected from the group consisting of sodium dihydrogen phosphate, potassium dihydrogen phosphate, disodium hydrogen phosphate, and dipotassium hydrogen phosphate. If necessary, an auxiliary component may be added to this phosphate. The auxiliary component is at least one member selected from the group consisting of sulfuric acid, nitric acid, acetic acid, oxalic acid, citric acid, phosphoric acid, pyrophosphoric acid, sodium sulfate, potassium sulfate, sodium nitrate, potassium nitrate, sodium acetate, potassium acetate, sodium oxalate, potassium oxalate, sodium citrate, potassium citrate, sodium phosphate, potassium phosphate, sodium pyrophosphate, and potassium pyrophosphate. These components are dissolved to form an aqueous solution, in which the magnet having undergone nickel electroplating is immersed. The solution has a concentration which is preferably 0.01 to 2 mole/liter, and more preferably 0.05 to 0.5 mole/liter of phosphate, but not particularly limited. The concentration of the auxiliary component, if added, is 0.01 to 0.1 mole/liter. With respect to the treatment conditions, the magnet is immersed for 1 to 60 minutes at 10 to 70° C. while heating if necessary. This is followed by water washing and drying by a standard technique like forced air circulation.

The phosphate-containing treatment liquid is preferably adjusted to pH between 0.3 and 6.5 or between 8.0 and 12.5. The pH adjustment may be performed either by changing the concentration of components, or by using potassium hydroxide or sodium hydroxide.

Without the phosphate treatment, no stable poisoning layer can be formed on the magnet surface, so that the magnet may deteriorate its own magnetic properties. The phosphate treatment is followed by water washing.

Once the desired nickel plating layer is formed on the R-T-B rare earth permanent magnet and subjected to phosphate treatment, it is heat treated in an oxygen-containing atmosphere for improving corrosion resistance. With respect to the oxygen concentration, the treating chamber atmosphere should be controlled to an oxygen partial pressure of at least $1.3\times10^3$ Pa (10 Torr), preferably $1.3\times10^4$ Pa ($1\times10^2$ Torr) to $6.5\times10^4$ Pa ($5\times10^2$ Torr), and more preferably $1.3\times10^4$ Pa ($1.0\times10^2$ Torr) to $2.6\times10^4$ Pa ($2.0\times10^2$ Torr). The heat treatment temperature is 150 to 400° C., preferably 250 to 400° C. and the treatment time is 1 to 24 hours, preferably 8 to 24 hours. Heat treatment under these conditions ensures that a corrosion resistant coating forms on the surface of the R-T-B rare earth permanent magnet. Too high a temperature or too long a time of heat treatment may degrade magnetic properties whereas too low a temperature or too short a time of heat treatment may fail to provide satisfactory cutting fluid resistance.

After the R-T-B rare earth permanent magnet is heat treated in the desired oxygen-containing atmosphere, it may be cooled at a rate of 10 to $2\times10^{3\circ}$ C./min. In some cases, heat treatment may be carried out in multiple stages. When the R-T-B rare earth permanent magnet as heat treated is cooled, cooling with a carrier gas (e.g., nitrogen or Ar) within the heat treatment chamber or air cooling outside the chamber is typical. Instead, the R-T-B rare earth permanent magnet as heat treated may be hardened with cold water or cooling medium, that is, quenched, if necessary. The cooling medium used in quenching may be selected, depending on the desired level of corrosion resistance, from cold water, weak acid solutions having phosphoric acid, citric acid, oxalic acid or the like dissolved therein, and weak alkaline solutions having potassium carbonate or the like dissolved therein.

The heat treatment forms an oxide layer in a surface region of the nickel plating, which layer preferably has a thickness equal to or less than 200 nm, more preferably 50 to 150 nm. Too thin a layer may provide insufficient corrosion resistant effect whereas too thick a layer may cause substantial discoloration or color shading on the magnet surface.

The highly corrosion resistant rare earth permanent magnets of the invention are advantageously used in industrial motors which use water-miscible metalworking fluid compositions applicable to a wide variety of metalworking including machining, cutting, grinding, and plastic working (including not only conventional water-miscible metalworking fluid compositions, but also water-miscible metalworking fluid compositions with improved anti-putrefying ability) and water-miscible metalworking fluids comprising the same.

The cutting fluids widely used in the machining, cutting and grinding fields include water-immiscible cutting fluids based on mineral oil, and water-miscible cutting fluids containing mineral oil, surfactant, organic amine and the like and to be diluted with water on use. To the water-miscible cutting fluids, amines having an antiseptic effect are often added for improving the anti-putrefying ability of the fluid.

For improving the anti-putrefying ability of the fluid, specific amines are used instead of the prior art antiseptic amines. Suitable amines include (1) triethanol amine, triisopropanol amine, methyl diethanol amine, etc., (2) monoisopropanol amine, 2-amino-2-methyl-1-propanol, etc., and (3) cyclohexylamine, dicyclohexylamine, etc. Notably, for emulsions containing a small amount of alkanol amine, the addition of an antiseptic agent is essential because the emulsions lack a pH maintenance ability. To this end, phenols such as o-phenylphenol, thiazolines such as benzisothiazoline, and triazine compounds of formaldehyde release type are used.

Other optional additives include silicone defoamers, alcohol defoamers, triazine antiseptics, alkyl benzimidazole antiseptics, alkyl benzimidazole metal corrosion-preventing agents, nonionic surfactants such as polyoxyethylene alkyl ethers, polyoxyethylene alkyl phenyl ethers, and carboxylic acid alkanol amides, coupling agents such as polyhydric alcohols, glycols and water, inorganic salts such as phosphoric acid salts, carbonic acid salts, boric acid salts, and silicic acid salts, ion trapping agents such as EDTA, and oil-type agents such as oxidized wax, natural oils and fats, synthetic oils and fats, synthetic esters, and high polymers.

In general, a water-miscible metalworking fluid composition containing such active ingredients, especially a water-miscible cutting fluid, is diluted with water to a volume of about 5 to 200 folds, prior to use.

The magnets of the invention are used in an atmosphere where they are exposed to water, lubricant and/or refrigerant for a long period of time, and especially in various industrial motors which use water-miscible metalworking fluid compositions and water-miscible metalworking fluids comprising the same, widely applicable to metal working such as machining, cutting, grinding and plastic working (typically motors compliant with the revised energy saving regulation of Japan) and in applications where they are exposed to water-miscible metalworking fluids or cutting fluids under operating conditions for a long period of time.

Nowadays, linear synchronous motors featuring high-speed driving and low-noise operation are employed, for example, in spindle/table feed mechanisms of machine tools or as the drive of various industrial machines. Many linear synchronous motors use permanent magnets in the magnetic field section in order to construct a simple drive mechanism. A permanent magnet field linear motor includes a magnetic field section, an armature, and a gap between the field section and the armature, wherein the field section has a plurality of permanent magnets arranged on a plate, and the armature has a winding which makes linear motion relative to the plurality of permanent magnets in a direction traversing sequentially the magnetic fields produced by the permanent magnets. Particularly when used in the spindle/table feed mechanisms, the motor has many chances to contact chemicals such as cutting fluids. When a permanent magnet having insufficient cutting fluid resistance is used, the permanent magnet may be provided with a special cover with concern of degraded magnetic properties and for mechanical reinforcement.

When the magnet of the invention is used in the drive mechanism of a machine tool including a linear motor where it will come in contact with an amine-containing water-miscible cutting fluid, it eliminates a need for special cover and satisfies all the requirements of low cost, light weight and high reliability. The invention is thus of great worth in the industry.

EXAMPLE

Examples and Comparative Examples are given below for further illustrating the invention, but the invention is not limited thereto.

Example 1

A cast ingot having the composition 32Nd-1.2B-59.8Fe-7Co in weight ratio was prepared by high-frequency melting in an argon atmosphere. The ingot was crushed on a jaw crusher and finely pulverized into a fine powder with an average particle size of 3.5 μm on a jet mill using nitrogen gas. The fine powder was then filled in a mold with a magnetic field of 10 kOe applied, and compacted under a pressure of 1.0 t/cm$^2$. The green compact was then sintered in vacuum at 1,100° C. for 2 hours and aged at 550° C. for 1 hour, obtaining a permanent magnet block.

From the permanent magnet block, a magnet piece of 20.0 mm long×20.0 mm wide×3.0 mm thick having an oxygen concentration of 0.58 wt %, Br=12.0 kG and iHc=21.0 kOe was cut out. This was followed by barrel finishing and ultrasonic cleaning with water. The magnet piece was pretreated with a dilute mineral acid such as hydrochloric acid, nitric acid or acetic acid, after which matte nickel electroplating was carried out in a Watt bath having nickel sulfate, nickel chloride and boric acid dissolved therein. The electroplating formed a nickel deposit having a thickness of 20 to 22 μm as measured at the magnet center by an X-ray thickness gage. The plated magnet piece was immersed in a 0.1 mol/L sodium dihydrogen phosphate aqueous solution at 30° C. for 30 seconds, washed with deionized water, and dried in a forced air circulation dryer at 80° C. for 5 minutes. The magnet piece was heat treated in an atmosphere having an oxygen concentration of 1.95×10$^4$ Pa (1.5×10$^2$ Torr) at 350° C. for 24 hours. The heat treatment formed a corrosion resistant layer composed mainly of nickel oxide on the surface of R-T-B rare earth permanent magnet, which layer had a thickness of about 40 to 100 nm as measured by XPS analysis.

The R—Fe—B rare earth permanent magnet was examined for corrosion resistance to cutting fluids. Five commercially available water-miscible cutting fluids (designated cutting fluids A to E) were diluted to a selected concentration. Of the water-miscible cutting fluids used, cutting fluids D and E were so-called biostatic cutting fluids which are improved in antibacterial property which is problematic for the water-miscible cutting fluid. Table 1 tabulates the type, pH value as diluted and antibacterial property of five water-miscible cutting fluids.

Next, a cutting fluid immersion test was carried out by charging a cap bolted pressure vessel (volume 200 ml, TPR-N2 type, Taiatsu Techno Co., Ltd.) with 100 ml of the cutting fluid diluent having the selected concentration. A test piece of R—Fe—B permanent magnet was placed therein. The vessel was fastened for tight seal. The pressure vessel was placed in an oil bath kept at 80±0.2° C. and 120±0.2° C.

Example 2

As in Example 1, a cast ingot having the composition 32Nd-1.2B-59.8Fe-7Co in weight ratio was prepared by high-frequency melting in an argon atmosphere. The ingot was crushed on a jaw crusher and finely pulverized into a fine powder with an average particle size of 3.5 μm on a jet mill using nitrogen gas. The fine powder was then filled in a mold with a magnetic field of 10 kOe applied, and compacted under a pressure of 1.0 t/cm$^2$. The green compact was then sintered in vacuum at 1,100° C. for 2 hours and aged at 550° C. for 1 hour, obtaining a permanent magnet block.

From the permanent magnet block, a magnet piece of 20.0 mm long×20.0 mm wide×3.0 mm thick having an oxygen concentration of 0.58 wt %, Br=12.0 kG and iHc=21.0 kOe was cut out. This was followed by barrel finishing and ultrasonic cleaning with water. The magnet piece was pretreated with a dilute mineral acid such as hydrochloric acid, nitric acid or acetic acid, after which matte nickel electroplating was carried out in a Watt bath having nickel sulfate, nickel chloride and boric acid dissolved therein. The electroplating formed a nickel deposit having a thickness of 20 to 22 μm as measured at the magnet center by an X-ray thickness gage. The plated magnet piece was immersed in a 0.1 mol/L potassium dihydrogen phosphate aqueous solution at 30° C. for 30 seconds, washed with deionized water, and dried in a forced air circulation dryer at 80° C. for 5 minutes. The magnet piece was heat treated in an atmosphere having an oxygen concentration of 1.95×10$^4$ Pa (1.5×10$^2$ Torr) at 350° C. for 8 hours. Using the thus obtained magnet as a test sample, a similar cutting fluid immersion test was carried out at 80° C. and 120° C.

Comparative Example 1

After a magnet piece of the predetermined dimensions was cut out of the block, nickel electroplating was omitted. Using this non-surface-treated magnet as a test sample, a similar cutting fluid immersion test was carried out at 80° C. and 120° C.

Comparative Example 2

A nickel plated piece of R—Fe—B permanent magnet was prepared as in Example 1 except that the heat treatment was

TABLE 1

| Cutting fluid | Manufacturer | Trade name | Concentration (vol %) | Diluent pH | Amine | Antibacterial property |
|---|---|---|---|---|---|---|
| A | Yushiro Chemical Industry Co., Ltd. | EC50T3 | 10 | 10.4 | absent | no |
| B | Yushiro Chemical Industry Co., Ltd. | MIC2000T | 5 | 10.2 | absent | no |
| C | Yushiro Chemical Industry Co., Ltd. | #770TG | 5 | 10.2 | absent | no |
| D | Kyodo Yushi Co., Ltd. | Multicool 8000B | 5 | 9.7 | present | yes |
| E | Castrol | Alusol-B | 5 | 8.6 | present | yes |

omitted. Using this magnet as a test sample, a similar cutting fluid immersion test was carried out at 80° C. and 120° C.

The results of the cutting fluid immersion test are shown in FIGS. 1 to 5 and Table 2.

FIG. 1 illustrates the magnetic properties of the R—Fe—B permanent magnet of Example 1 before and after the 80° C./4 week immersion test in five water-miscible cutting fluids. For all the five water-miscible cutting fluids, the magnetic properties remained intact even after the immersion test.

Figure 2:
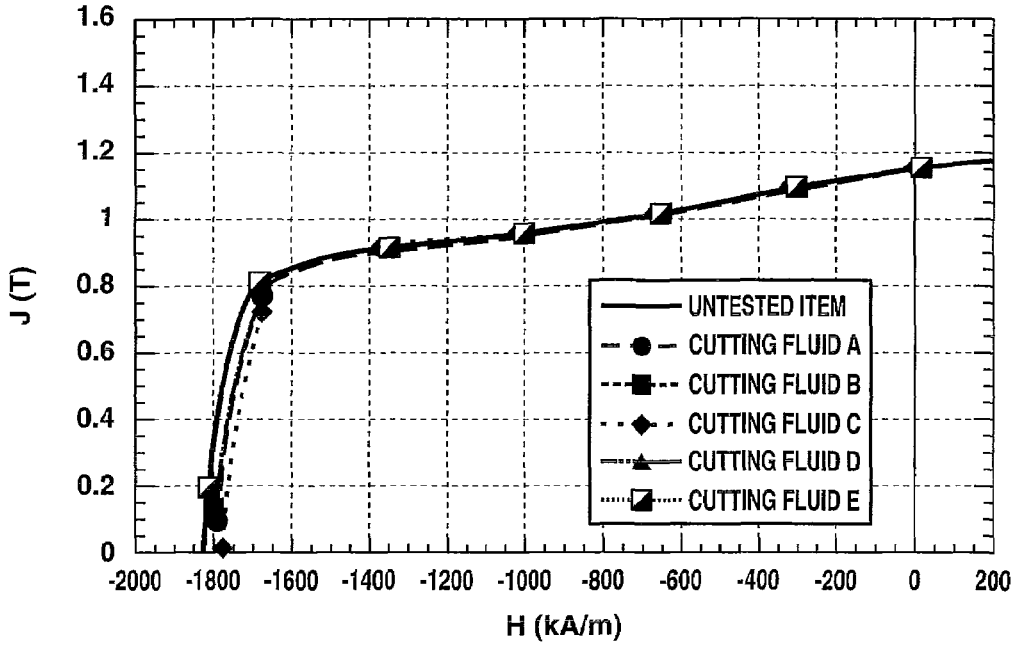
FIG. 2 is a diagram showing the magnetic properties of the magnet of Example 1 before and after the cutting fluid immersion test (120° C. and 1 week).

FIG. 2 illustrates the magnetic properties of the R—Fe—B permanent magnet of Example 1 before and after the 120° C./1 week immersion test in five water-miscible cutting fluids. For all the five water-miscible cutting fluids, the magnetic properties remained intact even after the immersion test.

Figure 3:
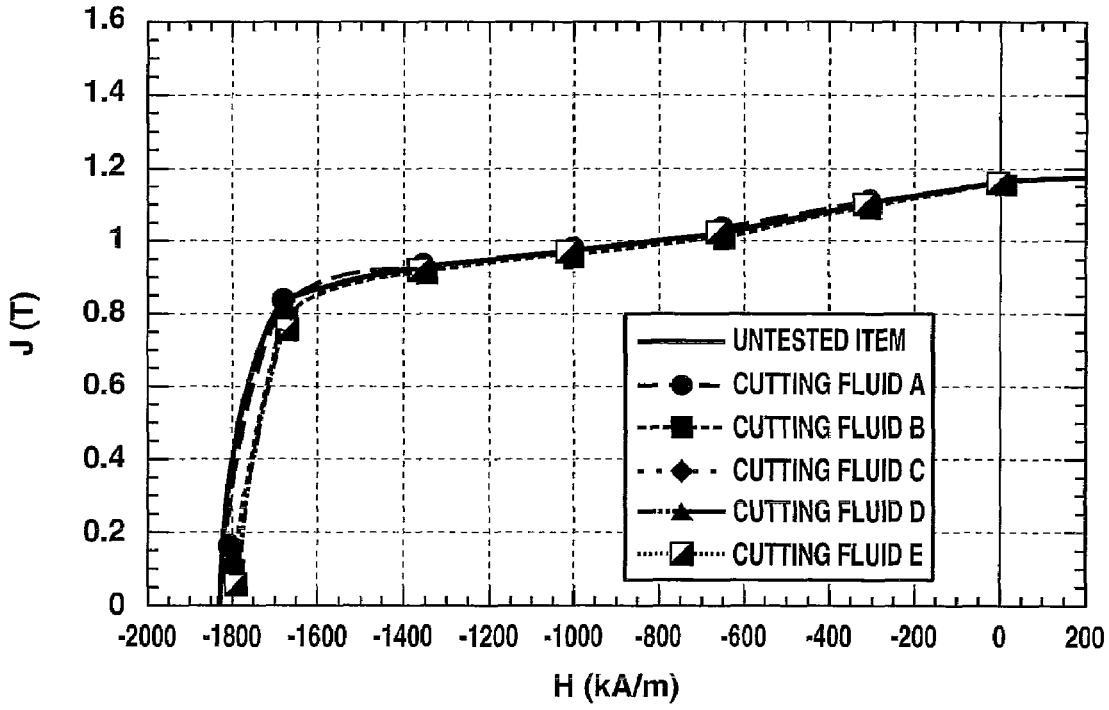
FIG. 3 is a diagram showing the magnetic properties of the magnet of Example 2 before and after the cutting fluid immersion test (80° C. and 4 weeks).

FIG. 3 illustrates the magnetic properties of the R—Fe—B permanent magnet of Example 2 before and after the 80° C./4 week immersion test in five water-miscible cutting fluids. For all the five water-miscible cutting fluids, the magnetic properties remained intact even after the immersion test.

Figure 4:
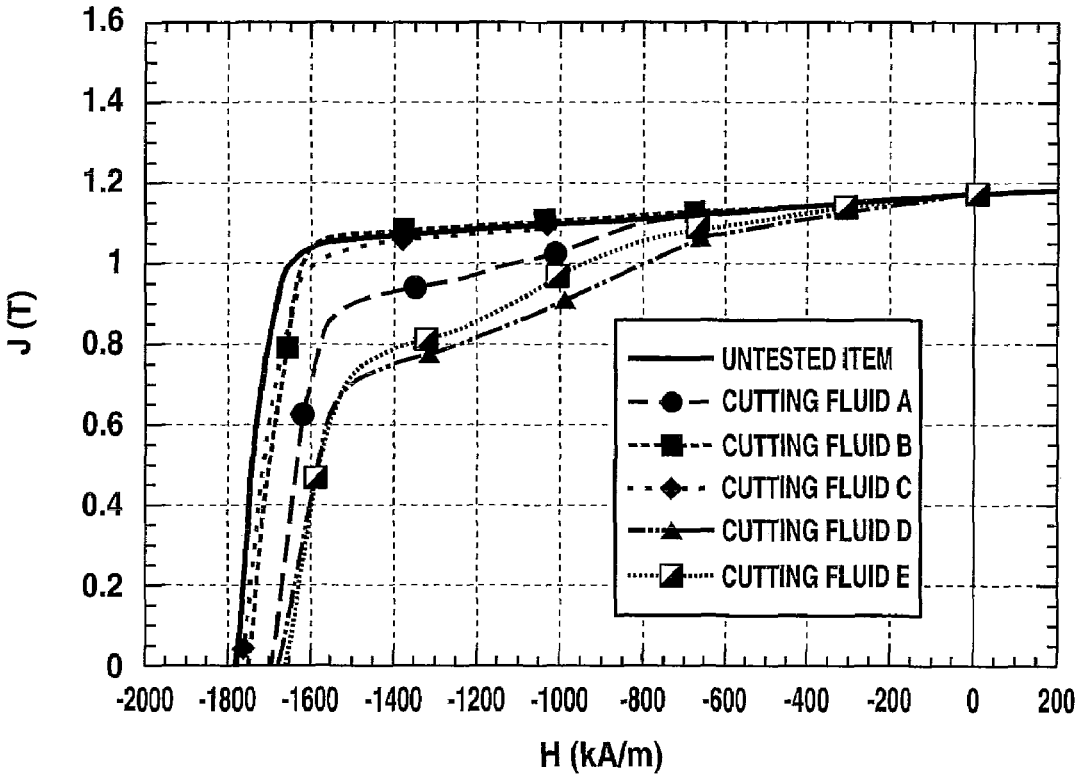
FIG. 4 is a diagram showing the magnetic properties of the magnet of Comparative Example 1 before and after the cutting fluid immersion test.

FIG. 4 illustrates changes of magnetic properties of the magnet of Comparative Example 1 before and after the 80° C./4 week immersion test in five water-miscible cutting fluids. For water-miscible cutting fluids A, D and E, the magnetic properties degraded apparently after the immersion test.

Figure 5:
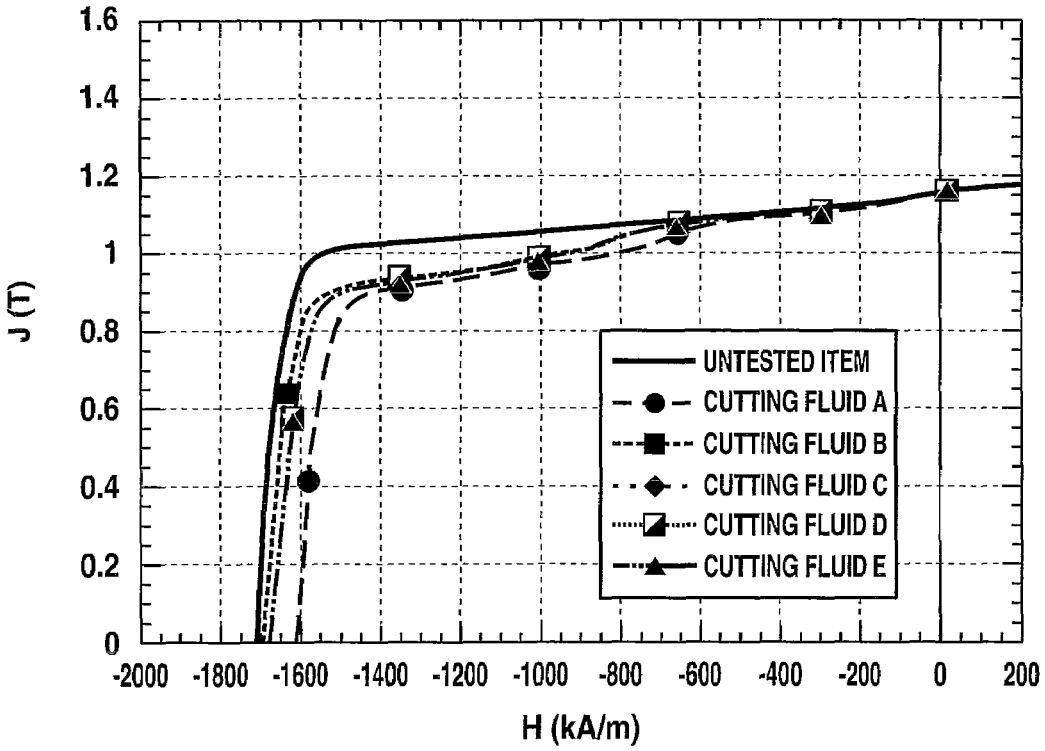
FIG. 5 is a diagram showing the magnetic properties of the magnet of Comparative Example 2 before and after the cutting fluid immersion test.

FIG. 5 illustrates changes of magnetic properties of the magnet of Comparative Example 2 before and after the 80° C./4 week immersion test in five water-miscible cutting fluids. For all the five water-miscible cutting fluids, the magnetic properties degraded apparently after the immersion test.

Table 2 tabulates the results of the cutting fluid immersion test on the R—Fe—B permanent magnets which were surface treated as in Examples 1 and 2 and Comparative Examples 1 and 2. It is evident that Examples 1 and 2 represent an excellent surface treatment method independent of the type of water-miscible cutting fluid (whether or not it is antibacterial) because the magnetic properties of the R—Fe—B permanent magnet are not impaired at all in a long-term immersion test.

TABLE 2

| | Cutting fluid immersion test | |
|---|---|---|
| | 80° C./4 weeks | 120° C./1 week |
| Example 1 | ◎ | ◎ |
| Example 2 | ◎ | ◎ |
| Comparative Example 1 | X | X |
| Comparative Example 2 | X | X |

◎: In all cutting fluids, no degradation of magnetic properties is observed.
X: In some cutting fluids, a degradation of magnetic properties is observed.

The above results demonstrate that if a nickel plated R—Fe—B rare earth permanent magnet is not heat treated in a controlled atmosphere (Comparative Example 2), its magnetic properties degrade significantly where it is exposed to a water-miscible cutting fluid at high temperature for a long time, specifically after 4 weeks at 80° C.

The invention claimed is:

1. A method for preparing a highly corrosion resistant rare earth permanent magnet, comprising the sequential steps of:

casting an alloy, said alloy containing R which is a rare earth element or a combination of two or more rare earth elements, T which is Fe or Fe and Co, and B as main components, and specifically consisting essentially of 26.8 to 33.5% by weight of R, 0.78 to 1.25% by weight of B, 0.05 to 3.5% by weight in total of at least one element selected from the group consisting of Ni, Ga, Zr, Nb, Hf, Ta, Mn, Sn, Mo, Zn, Pb, Sb, Al, Si, V, Cr, Ti, Cu, Ca, and Mg, and the balance of T and incidental impurities;

pulverizing the alloy in an oxygen-free atmosphere of argon, nitrogen or vacuum;

finely pulverizing, compacting in a magnetic field, sintering, and aging the finely pulverized, compacted and sintered alloy, thereby producing a sintered magnet, the magnet having an oxygen concentration of up to 0.6% by weight and magnetic properties, Br of 12.0 kG to 14.8 kG and iHc of 11 kOe to 35 kOe;

machining and/or grinding the magnet for surface finishing;

pretreating the magnet, which is machined and/or ground, with mineral acid, nickel electroplating the magnet, which is pretreated, to form a plating of a predetermined thickness;

immersing the magnet, which is nickel electroplated, in a phosphate-containing aqueous solution, washing with water; and further heat treating the magnet in an atmosphere having an oxygen partial pressure of at least $1.3\times10^3$ Pa (10 Torr) at 150 to 400° C. for 1 to 24 hours for thereby forming a thin nickel oxide layer in a surface region of the plating.

2. A method for preparing a highly corrosion resistant rare earth permanent magnet, comprising the sequential steps of:

providing a parent alloy containing R which is a rare earth element or a combination of two or more rare earth elements, T which is Fe or Fe and Co, and B as main components, and specifically consisting essentially of 26.8 to 33.5% by weight of R, 0.78 to 1.25% by weight of B, 0.05 to 3.5% by weight in total of at least one element selected from the group consisting of Ni, Ga, Zr, Nb, Hf, Ta, Mn, Sn, Mo, Zn, Pb, Sb, Al, Si, V, Cr, Ti, Cu, Ca, and Mg, and the balance of T and incidental impurities, providing an auxiliary alloy consisting essentially of 28 to 70% by weight of R' wherein R' is identical with R, 0 to 1.5% by weight of B, 0.05 to 10% by weight in total of at least one element selected from the group consisting of Ni, Ga, Zr, Nb, Hf, Ta, Mo, Al, Si, V, Cr, Ti, and Cu, and the balance of T and incidental impurities, said T consisting of at least 10% by weight of Co and up to 60% by weight of Fe based on the weight of T;

subjecting the parent alloy to pulverization in an oxygen-free atmosphere of argon, nitrogen or vacuum, combining 85 to 99% by weight of the parent alloy with 1 to 15% by weight of the auxiliary alloy;

finely pulverizing, compacting in a magnetic field, sintering, and aging the finely pulverized, compacted and sintered alloy, thereby producing a sintered magnet, the magnet having an oxygen concentration of up to 0.6% by weight and magnetic properties, Br of 12.0 kG to 14.8 kG and iHc of 11 kOe to 35 kOe, machining and/or ginding the magnet for surface finishing;

pretreating the magnet, which is machined and/or ground, with mineral acid, nickel electroplating the magnet, which is pretreated, to form a plating of a predetermined thickness;

immersing the magnet, which is nickel electroplated, in a phosphate-containing aqueous solution, washing with water; and further heat treating the magnet in an atmosphere having an oxygen partial pressure of at least $1.3\times10^3$ Pa (10 Torr) at 150 to 400° C. for 1 to 24 hours for thereby forming a thin nickel oxide layer in a surface region of the plating.

3. A method for preparing a highly corrosion resistant rare earth permanent magnet according to claim 1, wherein said phosphate-containing aqueous solution is an aqueous solution comprising at least one phosphate selected from the group consisting of sodium dihydrogen phosphate, potassium dihydrogen phosphate, disodium hydrogen phosphate, and dipotassium hydrogen phosphate, or said phosphate and at least one member selected from the group consisting of sulfuric acid, nitric acid, acetic acid, oxalic acid, citric acid, phosphoric acid, pyrophosphoric acid, sodium sulfate, potassium sulfate, sodium nitrate, potassium nitrate, sodium acetate, potassium acetate, sodium oxalate, potassium oxalate, sodium citrate, potassium citrate, sodium phosphate, potassium phosphate, sodium pyrophosphate, and potassium pyrophosphate.

4. A rare earth permanent magnet prepared by the method of claim 1, wherein the rare earth permanent magnet is disposed in a drive mechanism of a machine tool and comes in contact with an amine-containing water-miscible cutting fluid.

5. A method for preparing a highly corrosion resistant rare earth permanent magnet according to claim 2, wherein said phosphate-containing aqueous solution is an aqueous solution comprising at least one phosphate selected from the group consisting of sodium dihydrogen phosphate, potassium dihydrogen phosphate, disodium hydrogen phosphate, and dipotassium hydrogen phosphate, or said phosphate and at least one member selected from the group consisting of sulfuric acid, nitric acid, acetic acid, oxalic acid, citric acid, phosphoric acid, pyrophosphoric acid, sodium sulfate, potassium sulfate, sodium nitrate, potassium nitrate, sodium acetate, potassium acetate, sodium oxalate, potassium oxalate, sodium citrate, potassium citrate, sodium phosphate, potassium phosphate, sodium pyrophosphate, and potassium pyrophosphate.

6. A rare earth permanent magnet prepared by the method of claim 2, wherein the rare earth permanent magnet is disposed in a drive mechanism of a machine tool and comes in contact with an amine-containing water-miscible cutting fluid.

7. A rare earth permanent magnet prepared by the method of claim 3, wherein the rare earth permanent magnet is disposed in a drive mechanism of a machine tool and comes in contact with an amine-containing water-miscible cutting fluid.

* * * * *